US009649605B2

(12) United States Patent
Brown

(10) Patent No.: US 9,649,605 B2
(45) Date of Patent: May 16, 2017

(54) DYNAMIC MIXER

(71) Applicant: Maelstrom Advanced Process Technologies Ltd, Glossop (GB)

(72) Inventor: Christopher John Brown, Glossop (GB)

(73) Assignee: Maelstrom Advanced Process Technologies Ltd., Glossop (GB)

( * ) Notice: Subject to any disclaimer, the term of this patent is extended or adjusted under 35 U.S.C. 154(b) by 105 days.

(21) Appl. No.: 14/362,996

(22) PCT Filed: Dec. 5, 2012

(86) PCT No.: PCT/GB2012/053015

§ 371 (c)(1),
(2) Date: Jun. 5, 2014

(87) PCT Pub. No.: WO2013/088119

PCT Pub. Date: Jun. 20, 2013

(65) Prior Publication Data

US 2014/0334250 A1 Nov. 13, 2014

(30) Foreign Application Priority Data

Dec. 14, 2011 (GB) ..... 1121541.5

(51) Int. Cl.
*B01F 7/00* (2006.01)

(52) U.S. Cl.
CPC ..... *B01F 7/00* (2013.01); *B01F 7/00816* (2013.01); *B01F 7/00825* (2013.01); *B01F 7/00833* (2013.01)

(58) Field of Classification Search
CPC ..... B01F 7/00816; B01F 7/00825; B01F 7/00833; B01F 7/00

(Continued)

(56) References Cited

U.S. PATENT DOCUMENTS 1,670,593 A * 5/1928 Miller ..... B01F 7/00766 366/303
2,744,287 A * 5/1956 Parshall ..... B29B 7/425 241/158

(Continued)

FOREIGN PATENT DOCUMENTS

CN 1473069 A 2/2004
DE 0344399 A1 12/1989

(Continued)

OTHER PUBLICATIONS

International Search Report and Written Opinion, from PCT/GB2012/053015 with an international filing date of Dec. 5, 2012, 5 pgs., mailed from the European Patent Office, Rijswijk, The Netherlands.

(Continued)

*Primary Examiner* — Abbas Rashid

(74) *Attorney, Agent, or Firm* — Baker & Hostetler LLP

(57) ABSTRACT

A dynamic mixer comprising two mixing parts which are rotatable relative to each other about a predetermined axis of rotation, each of said mixing parts having a mixing face, between which is defined a flow path which extends between an inlet and an outlet, each of said mixing faces comprising a series of annular steps centered on the predetermined axis of rotation, having a plurality of offset and overlapping cavities formed therein, such that material moving between the mixing faces of the two mixing parts from the inlet to the outlet is transferable between overlapping cavities.

18 Claims, 6 Drawing Sheets

(58) Field of Classification Search
USPC ..... 366/181.4
See application file for complete search history.

(56) References Cited

U.S. PATENT DOCUMENTS

| | | | | | |
|---|---|---|---|---|---|
| 2,969,960 | A * | 1/1961 | Gurley, Jr. | B01F 7/00816 | 261/DIG. 26 |
| 2,995,346 | A * | 8/1961 | Samples | B01F 7/00816 | 165/109.1 |
| 3,174,185 | A * | 3/1965 | Gerber | B29C 47/527 | 366/99 |
| 3,395,805 | A * | 8/1968 | Clayton | B01D 33/0006 | 210/179 |
| 3,675,903 | A * | 7/1972 | Harper | B01F 7/00816 | 366/290 |
| 3,806,050 | A * | 4/1974 | Cumpston, Jr. | B01F 7/00816 | 241/260 |
| RE29,053 | E * | 11/1976 | Cumpston, Jr. | B01F 7/00816 | 241/260 |
| 4,004,553 | A | 1/1977 | Stenstrom | | |
| 4,419,014 | A * | 12/1983 | Gale | B01F 7/00816 | 366/279 |
| 4,582,433 | A * | 4/1986 | Mehta | B01F 7/00816 | 366/307 |
| 4,680,132 | A * | 7/1987 | Clarke | B01F 7/00816 | 264/176.1 |
| 4,840,810 | A * | 6/1989 | Bodor | A23D 7/02 | 426/312 |
| 4,844,928 | A * | 7/1989 | van Heteren | A23D 7/015 | 426/312 |
| 5,421,650 | A * | 6/1995 | Meyer | B29B 7/425 | 366/323 |
| 6,086,239 | A * | 7/2000 | Jarvenkyla | B29C 47/0023 | 366/305 |
| 6,648,500 | B2 * | 11/2003 | Fedorov | B01F 7/008 | 366/285 |
| 7,237,943 | B2 * | 7/2007 | Brown | B01F 7/00833 | 366/303 |
| 2004/0052156 | A1 * | 3/2004 | Brown | B01F 7/00833 | 366/286 |
| 2005/0047270 | A1 * | 3/2005 | Wood | A01K 63/042 | 366/170.3 |
| 2012/0127826 | A1 * | 5/2012 | Brown | B01F 7/00808 | 366/297 |

FOREIGN PATENT DOCUMENTS

| | | | |
|---|---|---|---|
| JP | 63049239 | A | 3/1988 |
| WO | 0238263 | A1 | 5/2002 |
| WO | 2010089322 | A1 | 8/2010 |
| WO | 2010091983 | A1 | 8/2010 |

OTHER PUBLICATIONS

Preliminary Report on Patentability and Written Opinion, from PCT/GB2012/053015 with an international filing date of Dec. 5, 2012, 9 pgs., mailed from the European Patent Office, Geneva, Switzerland.

First Office action, from CN Application No. 2012800619330 filed May 12, 2012, dated Aug. 11, 2015, 9 pages, mailed from Chinese Patent Office, China—English Translation.

* cited by examiner

DYNAMIC MIXER

CROSS-REFERENCE TO RELATED APPLICATIONS

This application is a National Stage of International patent application PCT/GB2012/053015, filed on Dec. 5, 2012, which claims priority to foreign United Kingdom patent application No. GB 1121541.5, filed on Dec. 14, 2011, the disclosures of which are incorporated by reference in their entirety.

FIELD OF THE INVENTION

The present invention relates to a dynamic mixer and in particular to an improved dynamic mixer having desirable (or further desirable) mixing characteristics as compared to prior art mixers.

BACKGROUND

Dynamic mixers are known which comprise two elements or mixing parts which are rotatable relative to each other about a predetermined axis and between which is defined a flow path extending between an inlet for materials to be mixed and an outlet. In such known mixers, the flow path is defined between surfaces of the mixing parts, each of which surfaces has cavities formed within it. Cavities formed in one surface are offset in the axial direction relative to cavities in the other surface, and cavities in one surface overlap in the axial direction with cavities in the other surface. As a result, material moving between the surfaces is transferred between overlapping cavities. Thus, in use, material to be mixed is moved between the mixing parts and traces a path through cavities located alternately on each of the two surfaces. Such mixers incorporating cavities are generally referred to as "cavity transfer mixers".

Known cavity transfer mixers may have either a cylindrical geometry, that is an inner mixing part having a generally cylindrical outer surface which typically forms a rotor of the device and an outer mixing part having a generally cylindrical inner surface which typically forms a stator of the device, or, more recently, a stepped conical geometry, that is an inner mixing (rotor) part having a generally conical outer surface and an outer mixing (stator) part having a generally conical inner surface. In both cases, rows of cavities are formed in the two facing outer and inner surfaces, the rows of cavities overlapping in the axial direction such that material to be mixed generally passes from a cavity in one row of one surface into a cavity in an adjacent row of the other surface.

Stepped conical geometry cavity transfer mixers, for example as described in WO02/38263A1, are preferred over cylindrical cavity transfer mixers for a number of reasons, including that with a cylindrical mixer it is often necessary to manufacture the outer stator in splittable form so as to enable the formation of rows of cavities in its inner surface, whereas the complementary stepped conical geometry of each of the stator and rotor in a stepped conical geometry cavity transfer mixer means that each part can be manufactured whole with the cavities easily formable in both surfaces; the lack of an open annular space between the stator and rotor with a stepped conical geometry mixer, unlike a cylindrical mixer, which reduces the likelihood of material passing straight through said space effectively bypassing the cavities; the reduced likelihood of asymmetrical transfers with a stepped conical geometry mixer, unlike a cylindrical mixer, which transfers may cause axial back flow or front flow that can generate stagnation patterns with resultant accumulation of material in the cavities; and the lack of self-pumping and/or self-cleaning capabilities with cylindrical cavity transfer mixers, to name a few. However, by far the main reason for choosing a stepped conical geometry cavity transfer mixer, particularly that described in WO02/38263A1, in preference to a cylindrical cavity transfer mixer lies is because of the excellent distributive and dispersive mixing that can be achieved.

The aim of distributive mixing of a material is to improve the spatial distribution and uniformity of its components, with any inherent cohesive resistance in the material playing an insignificant role. Distributive mixing is also sometimes referred to as "simple mixing" or "extensive mixing". With dispersive mixing however, inherent cohesive resistance in the material(s) being mixed has to be overcome in order to achieve finer levels of dispersion. Dispersive mixing is also sometimes referred to as "intensive mixing" and is often more difficult to achieve than distributive mixing; this was true at least until the advent of the stepped conical geometry transfer, especially that described in WO02/38263A1, which as noted above enables achievement of excellent distributive and dispersive mixing.

However, despite the clear advantages of using a stepped conical geometry cavity transfer mixer over a cylindrical geometry cavity transfer mixer, it would be desirable to improve upon the excellent distributive and dispersive mixing achievable with a known stepped conical geometry mixer, for example by reducing the magnitude of the pressure drop that may occur on material transfer from the inlet to the outlet, by optimising the extensional and/or shear stresses applied to a material being mixed by suitable control thereof, and by the ability to provide uniform shear and extensional stresses.

It is therefore an object of the present invention to provide a cavity transfer mixer that is improved as compared to known cavity transfer mixers, particular as compared to stepped conical geometry mixers, especially (but not essentially) in relation to any of the desired aspects described in the preceding paragraph.

SUMMARY

Accordingly, the present invention provides a dynamic mixer comprising: two mixing parts which are rotatable relative to each other about a predetermined axis of rotation, each of said mixing parts having a mixing face, between which is defined a flow path which extends between an inlet for material to be mixed and an outlet, each of said mixing faces comprising a series of annular steps centred on the predetermined axis of rotation, having a plurality of cavities formed therein, said cavities defining flow passages bridging adjacent steps on each of the two mixing parts, each of said mixing faces being mutually positionable such that the steps of one mixing part extend towards recesses formed between the steps of the other mixing part, whereby cavities present in one mixing face are offset relative to, and overlap with, cavities present in the other mixing face in an axial direction or a transverse direction, such that material moving between the mixing faces of the two mixing parts from the inlet to the outlet is transferrable between overlapping cavities, wherein at least one step of one of the mixing parts and at least one adjacent step of the other of the mixing parts extends further in the axial direction than in a transverse direction, or vice versa, such that at least one annular mixing zone of substantially uniform volume in which shear and extensional stresses may be imparted to the material being mixed is provided between the two mixing parts.

Provision of such an improved dynamic mixer is beneficial as it enables a reduction in the magnitude of the pressure drop that may otherwise occur on material transfer from the inlet to the outlet, it enables optimisation of the extensional and/or shear stresses being applied to the material and allows suitable control thereof, it enables the provision of uniform shear and extensional stresses, and importantly retains the excellent distributive and dispersive mixing characteristics achievable with known stepped conical geometry mixer. These benefits arise from the fact that the annular steps overlap in a direction perpendicular to the flow path so that steps on one mixing part extend into recesses between steps on the other mixing part, and because of the presence of the at least one annular, typically high stress, mixing zone of uniform volume adjacent cavities present in said annular steps between the two relatively rotating mixing parts. Material entering a cavity in one direction is in effect redirected to exit that cavity in a different direction prior to being ejected and compelled to flow through the at least one annular mixing zone, and thereafter preferably compelled to transfer into at least one further cavity along its flow path. Such a mixer thus provides highly effective and efficient distributive and dispersive mixing, results in reduced pressure drop over the length of the flow path and enables optimised extensional and/or shear stresses to be imparted.

The flow path for the material to follow through the mixer utilises the narrow spacing/gap that exists between the two mixing parts; this gap may typically be of the order of tens of microns (e.g. 50 μm). Of course, where overlapping cavities are provided, this spacing/gap is necessarily greater than is otherwise present between the two relatively rotating mixing parts in the at least one annular mixing zone(s) where no cavities are provided. In the at least one annular mixing zone(s), the material to be mixed is subjected to intensive shear and extensional stresses.

In a mixer according to the invention, each step of the series of annular steps may comprise a pair of substantially orthogonal surfaces. One or both of these surfaces may be planar or may be curved. Extension of the at least one step of one of the mixing parts and extension of the at least one adjacent step of the other of the mixing parts in the mixer preferably results in a pair of mutually opposed, further preferably continuous, annular surfaces forming the at least one annular mixing zone. At least two, and possibly a plurality of, annular mixing zones, which may be non-identical in their respective volumes, may be present in a mixer according to the invention, thereby being one means for providing control of the extensional and/or shear stress optimisation.

One of the surfaces comprised in an annular step may extend substantially parallel to the predetermined axis of rotation, and as such may be referred to hereinafter as an "axial surface", whilst the other of the surfaces may extend substantially transversely to said axis of rotation, and as such may be referred to hereinafter as a "transverse surface". Depending on the particular configuration of the mixer, the pair of mutually opposed annular surfaces may both extend substantially parallel to the predetermined axis of rotation. In such a configuration, one of the surfaces of the pair of mutually opposed annular surfaces may extend at an angle, preferably an acute angle, to the predetermined axis of rotation. Alternatively, the pair of mutually opposed annular surfaces may both extend substantially transversely to the predetermined axis of rotation. In such an alternative configuration, one of the surfaces of the pair of mutually opposed annular surfaces may extend at an angle, preferably an acute angle, transversely to the predetermined axis of rotation.

In a second embodiment of the invention, at least one of the surfaces of the pair of mutually opposed annular surfaces may preferably be provided with a projection which projects towards to the other of the surfaces in the pair, so as to reduce the spacing/gap therebetween (e.g. from around 50 μm to 10 μm or less). Such an embodiment may be particularly beneficial when the other of the surfaces extends at an angle, preferably an acute angle, either to or transversely to the predetermined axis of rotation (as described above) because the relative axial positions of the projection and the angled surface are readily and precisely controllable so as to precisely define the spacing/gap therebetween. Such exceptional control means that very small spacings (of the order of tens of micrometres or less) between the surface projection and the other surface are readily achievable, again providing means for controlling of the extensional and/or shear stress optimisation, and means for reducing the pressure drop across the system.

In a preferred embodiment, the projection may be in the form of an annular prism, which may, preferably, be continuous or may be a segmented annular prism, i.e. it may be non-continuous. Furthermore the projection may exhibit a truncated cross-section. Preferably, the projection may be in the form of an annular prism having a triangular, preferably truncated triangular, prismatic cross-section, noting however that the cross-section may alternatively be of any other suitable form, e.g. quadrilateral, curved, etc.

The form of the projections may vary between each successive projection, such that differing spacings/gaps are achievable along the length of the flow path between inlet and outlet, thereby varying the extensional and/or shear stresses applied to the material being mixed.

Turning to the nature of the cavities formed in each of the mixing faces of a mixer according to the invention, an array of circumferentially spaced cavities may be formed in a step of the series of annular steps. Each annular step may be provided with such an array. Each of the cavities may be part spherical or of any other geometric form suitable to define a flow path, such as straight-sided slots and curved-sided slots. In addition, each or some of the cavities may be branched such that material flowing along the flow passage defined by a cavity in a single projection is divided into separate streams before it exits that flow passage, or separate streams of material in different branches are combined.

As a result of the configuration of the series of annular steps having cavities therein, the mixer itself comprises a plurality of interfacial surfaces at varying distances from the axis of rotation. This is of particular importance in batch mixing systems because the difference in kinetic energy imparted by this plurality of surfaces to a material being mixed provides a motive force to the material that tends to propel it through the mixer. The result is a pumping action which reduces the possibility of material becoming lodged within the mixer.

Furthermore, the flow passages defined by the cavities may be shaped and/or angled to increase the pumping action, and the propulsive forces thus obtained may be used to pump material through the mixer and/or to empty the mixer at the end of its mixing operation, providing self-cleaning functionality. Such configuration is of particular importance in processing higher viscosity materials, e.g. polymers.

Of course, the arrangement could be reversed such that the material is forced, by some external pumping means, to flow radially inwards, reversing the inlet and outlet. In such circumstances the inherent centrifugal pumping action provides back pressure and a more intensive mixing action. An application of such a "reverse" arrangement would be as an in-line mixer in which some degree of back-mixing is required.

Given that the number and/or size and/or shape of the cavities may be varied as between adjacent annular steps in a series, the material to be mixed may be forced to split into different streams as it passes through the mixer. Each of the flow passages presents a well-defined entrance zone and exit zone to material passing from the inlet to the outlet. The relative sizes of these entrance and exit zones could be controlled so as to be different within one cavity, within one row of cavities, or between rows of cavities. This ability to vary the relative sizes between entrances and exits to cavities enables the local flow characteristics to be adjusted to provide varying flow velocities and pressures.

Such benefits arising from the possible cavity variations are in support of the presence of at least one annular mixing zone between the two mixing parts of the mixer.

Preferably, in a series of annular steps in each of the mixing parts, an annular mixing zone may be present between each successive step, or between every other annular step, and there may be suitable correlation between the two mixing parts. Of course, many different permutations of annular steps and annular mixing zones may be provided depending on the ultimate mixing characteristics desired.

To facilitate further modes of control of the mixing characteristics, adjacent steps of the series of annular steps in a mixing part may defined different numbers, sizes and/or shapes of cavities.

The overall configuration of the mixer may be such that the mixing faces of each of the two mixing parts are generally conical. As a result, the two mixing parts may be mutually rotatably arranged such that the gap between adjacent annular steps present in each of the mixing faces (except where cavities are provided) is substantially constant throughout the flow path. In a preferred embodiment, the mixing surfaces of the two mixing parts may be generally conical with the annular steps shaped such that an inner conical mixing part (which may also be referred to herein as a rotor) can be positioned within an outer conical mixing part (which may also be referred to herein as a stator) by relative lateral displacement between the two mixing parts in a direction parallel to the predetermined axis of rotation. Of course, it is equally possible that the inner conical mixing part is stationary (i.e. the stator) and the outer conical mixing part is rotatable (i.e. the rotor), or that both inner and outer conical mixing parts are co-rotated (i.e. rotated in the same direction at the same or different speeds), or that the inner and outer mixing parts are contra-rotated (i.e. rotated in opposing directions at the same or different speeds). Such arrangements again benefits from the fact that neither mixing part needs to be splittable into two halves because their inherent configurations mean it is relatively easy to machine or otherwise form the annular steps and the cavities therein.

Means may be provided for axially displacing the two mixing parts relative to each other during use to control the spacing/gap between their generally conical surfaces. One surface may be defined by an inner surface of a hollow outer mixing part (the stator) and the other surface may be defined by an outer surface of a solid inner mixing part (the rotor), the inlet being defined in the outer mixing part. Alternatively that arrangement could be reversed such that the inner mixing part (the rotor) is hollow and the inlet is defined therein. Adjustment of the relative axial positions of the two mixing parts provides additional control of the spacing between the mixing surfaces, particularly those defining the at least one annular mixing zone, so as to provide an additional adjustable control mechanism. Such adjustment would result in different levels of shear stressing on the material being transferred between cavities in the adjacent elements.

In terms of relative orientations, the inlet into the mixer may be defined so as to extend substantially parallel to the predetermined axis of rotation, whilst the outlet may be defined so as to extend substantially transversely to said axis. Alternatively, each of the inlet and outlet may be defined so as to extend substantially transversely to the predetermined axis or rotation.

Of further benefit, the mixer according to the invention may be provided with one or more additional inlets through which additional or different materials may be introduced, e.g. by injection or other suitable input means. Such additional inlets may be located such that different materials can be added at different stages during the mixing process and so as to take into account additional of reactive intermediate species into the materials being mixed. Furthermore, materials introduced into later stages may typically be at a lower pressure than those introduced earlier—this can reduce the cost and complexity of any related pumping system.

A mixer according to the invention will be mechanically robust and may have suitable heating/cooling capability built in so as to compensate (as necessary) for any expansion/contraction of any of its component parts, including the two mixing parts or sections thereof, so as to avoid unwanted mechanical contact therebetween. Avoidance of contact is of particular importance in the at least one annular mixing zone in which the annular surfaces are usually in an extremely intimate spaced relationship (as discussed above, possibly of the order of 10 μm or less.

Furthermore, at least one of the two mixing parts may support an impeller to provide a pumping effect when said two mixing parts are rotated relative to each other. As to the manner in which this may be achieved, reference may be made to the relevant teaching in WO02/38263A1.

It will be appreciated that a mixer according to the present invention could be combined with auxiliary equipment, for example an arrangement to cut material into smaller pieces prior to mixing. Furthermore, a mixer according to the invention is extremely versatile and can be used in many different applications, for example, in all fluid to fluid mixing and fluid to solid mixing applications, including solids that exhibit fluid-like flow behaviour, in particle size comminution, viscosity modification and reaction rate enhancement. The fluids may be liquids and gases delivered in single and/or multiple streams.

A mixer according to the invention can be used for all dispersive and distributive mixing operations including emulsifying, homogenizing, blending, incorporating, suspending, dissolving, heating, size reducing (comminution), reacting, wetting, hydrating, aerating and gasifying, and such like. As mentioned above, a mixer according to the invention may be employed in either batch or continuous (in-line) operations. Thus the present mixer could be used to replace conventional cavity transfer mixers (including both cylindrical mixers and stepped conical geometry mixers) or to replace standard industrial high shear mixers. Furthermore, a mixer according to the invention will find utility in both domestic as well as industrial applications. Examples of industries in which a mixer according to the invention would be suitable for use include bulk chemicals, fine chemicals, petrochemicals, agrochemicals, food, drink, pharmaceuticals, healthcare products, personal care products, industrial and domestic care products, packaging, paints, polymers, water and waste treatment.

The present invention also provides a method of mixing using a dynamic mixer as defined above, operating at a relatively low speed to produce laminar flow conditions which result in effective distributive mixing within and between cavities, while producing laminar or turbulent flow conditions within the annular mixing zone that result in effective dispersive mixing. This has application, for instance, when processing materials that demand minimal amounts of stress while blending, followed by a short period of high stress, followed again by a period of low stress agitation.

The present invention further provides a method of mixing using a dynamic mixer as defined above operating at a relatively high speed to produce turbulent flow conditions within and between cavities which result in effective distributive and dispersive mixing that augments the predominantly dispersive mixing in the high stress zone by providing appropriate levels of pre- and/or post-processing.

BRIEF DESCRIPTION OF THE DRAWINGS

To enable a better understanding, the present invention will now be more particularly described, by way of non-limiting example only, with reference to the schematic drawings (not to scale), in which.

DETAILED DESCRIPTION

Figure 1:
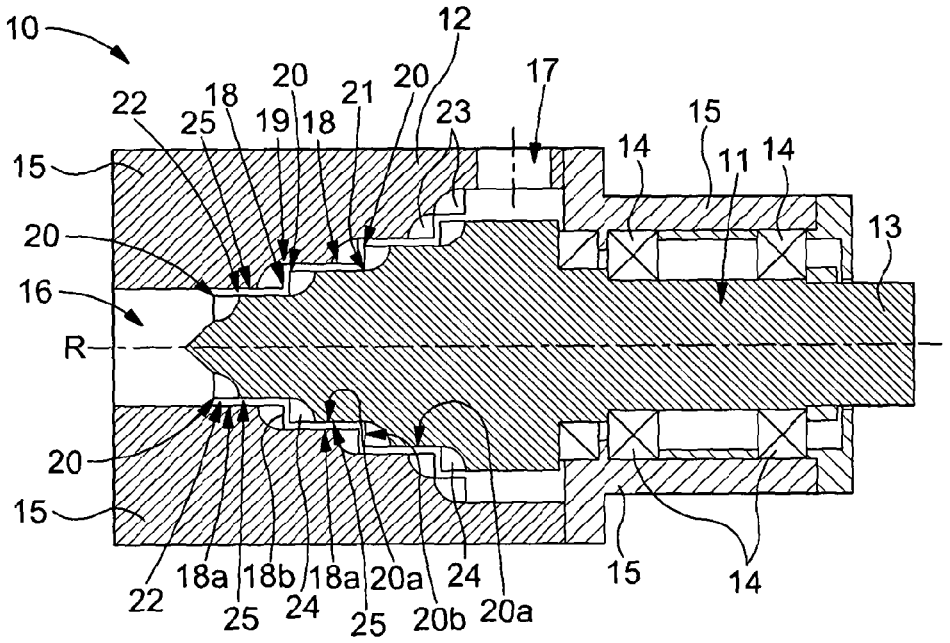
FIG. 1 is an axial section through a mixer according to a first embodiment of the present invention.

Referring to FIG. 1, the illustrated dynamic mixer 10 comprises two mixing parts in the form of an inner rotor 11 and an outer stator 12 which are rotatable relative to each other, in this case rotor 11 being rotatable relative to static stator 12, about a predetermined axis of rotation R. Rotor 11 is mounted on a shaft 13, which is supported in bearings 14 within a housing 15. Stator 12 is mounted on housing 15. Stator 12 defines a mixer inlet 16 and a mixer outlet 17.

A series of four annular steps 18 extend along the generally conical inner mixing surface of stator 12, each step 18 being defined by a first surface 18*a* which is cylindrical and centred on axis R (thus being an axial surface) and a second surface 18*b* which is planar and perpendicular to axis R (thus being a transverse surface). A recess 19 is formed where the first surface 18*a* of one step 18 meets the second surface 18*b* of the adjacent step 18. Each of first surfaces 18*a* clearly extends further in the axial direction than in the transverse direction, i.e. the direction in which second surfaces 18*b* extend.

Rotor 11 similarly supports four annular steps 20 which extend along the generally conical outer mixing surface of rotor 11, each step 20 being defined by a first surface 20*a* which is cylindrical and centred on axis R (thus being an axial surface) and a second surface 20*b* which is planar and perpendicular to axis R (thus being a transverse surface). A recess 21 is formed where the first surface 20*a* of one step 20 meets the second surface 20*b* of the adjacent step 20. Again each of first surfaces 20*a* clearly extends further in the axial direction than in the transverse direction, i.e. the direction in which second surfaces 20*b* extend.

As shown in FIG. 1, with rotor 11 located within the hollow of stator 12, first surfaces 18*a* of stator are in a closely spaced relationship with first surfaces 20*a* of rotor, whilst second surfaces 18*b* of stator are in a closely spaced relationship with second surfaces 20*b* of rotor, with the closely spaced relationship defining a small gap 22 (for example of the order of 50 μm) therebetween. Typically, the higher the viscosity of the material to be processed, the larger the gap between the surfaces will be, and vice versa.

Clearly gap 22 is not linear as it extends from inlet 16 to outlet 17 as it traces the stepped conical shapes of each of rotor 11 and stator 12. Thus material (not shown) passing from inlet 16 to outlet 17 is unable to follow a linear path.

Figure 2:
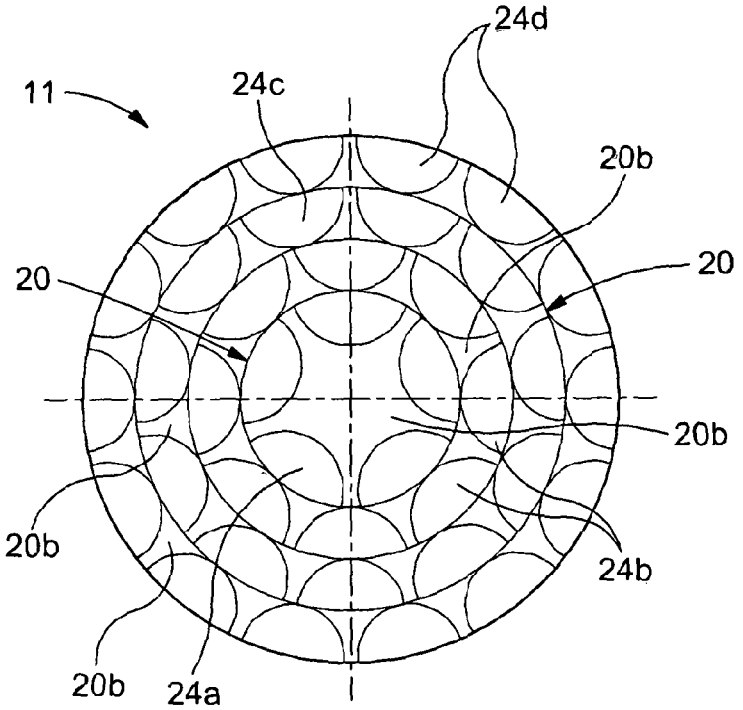
FIG. 2 is an end view of a mixing part of the mixer of FIG. 1.

A plurality of cavities 23 is provided in each of the annular steps 18 of stator 12, and a plurality of cavities 24 is provided in each of the annular steps 20 of rotor 11, the configuration of which in rotor 11 is best seen in FIG. 2 which will be described in more detail below. Notwithstanding, the mutual configurations of cavities 23, 24 on each of stator 12 and rotor 11 are such as to be offset but overlapping in the axial direction relative to one another to facilitate movement of material from inlet 16 to outlet 17.

Importantly, in the axial direction between non-overlapping cavities 23 of stator 12 and cavities 24 of rotor 11, annular mixing zones 25 are provided between the axially extended first surfaces 18*a*, 20*a* of each of stator 12 and rotor 11 respectively. Gap 22 in the region of annular mixing zones 25 remains constant, thus providing regions of substantially uniform volume in which high extensional and/or shear stressing of the material (not shown) being mixed will be imparted. Of course, it is within the scope of the present invention that gap 22 could be varied in successive annular mixing zones 25.

Referring to FIG. 2, transverse second surfaces 20*b* of annular steps 20 of rotor 11 are shown. In each of these planar surfaces 20*b*, an equally spaced array of cavities 24 is provided. In the innermost annular step 20, five cavities 24*a* are formed. In the next annular step (having a larger diameter in accordance with the generally conical shape of rotor 11), eight cavities 24*b* are formed. In the next annular step (having a yet larger diameter), eleven cavities 24*c* are formed. Finally, in the outermost annular step (having the largest diameter), fourteen cavities 24*d* are formed. Each of the cavities 24 is part-spherical and arranged such that the periphery of each (apart from those located in the innermost annular step) extends across the full width of the surface 20*b*, but only part way along the width of axial first surfaces 20*a*, which are extended in the axial direction to provide annular mixing zone 25.

Figure 3:
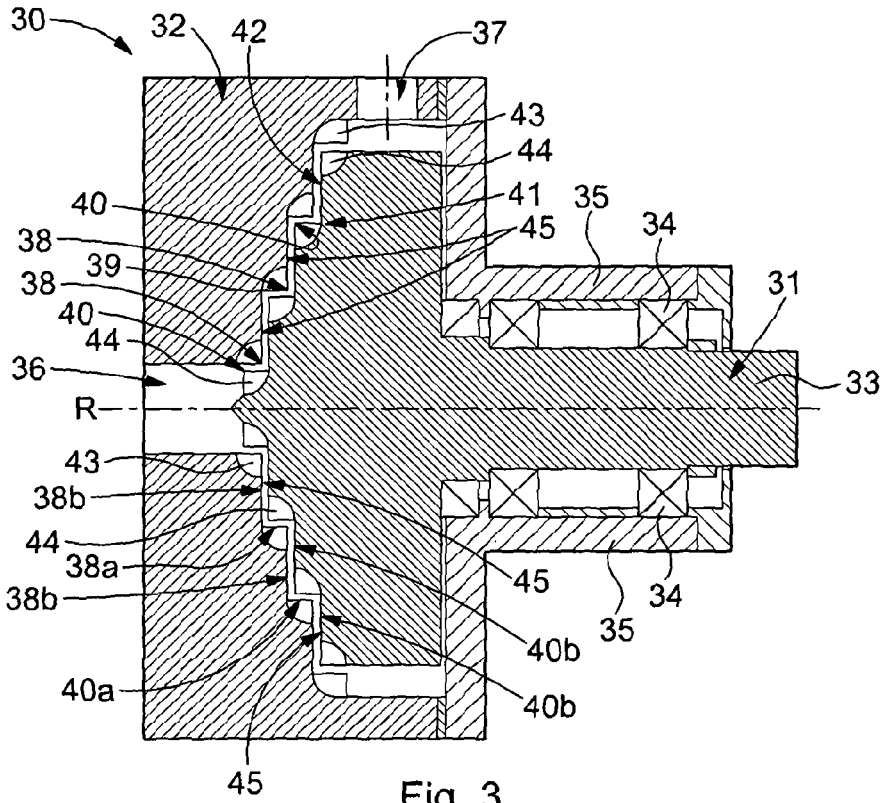
FIG. 3 is an axial section through an alternative mixer according to the first embodiment of the present invention.
Figure 4:
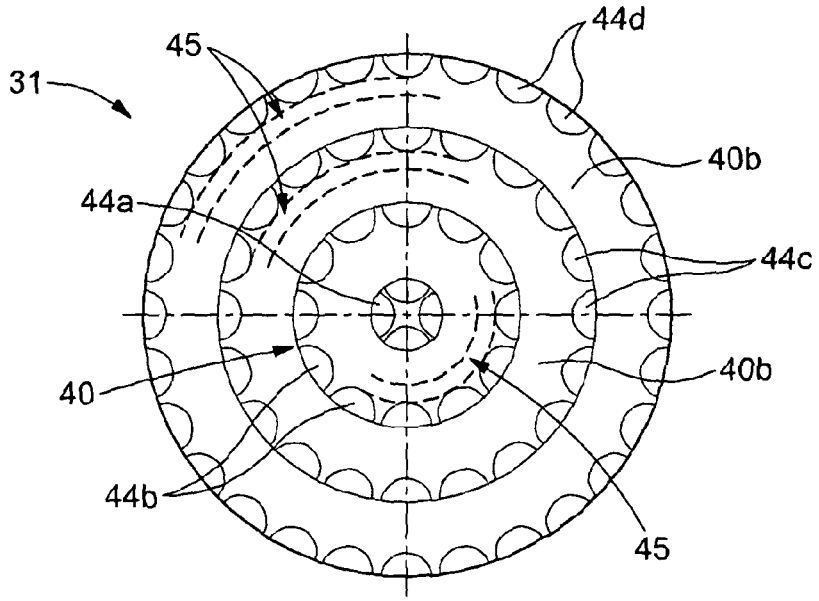
FIG. 4 is an end view of a mixing part of the mixer of FIG. 3.

Referring to FIGS. 3 and 4, dynamic mixer 30 is similar to dynamic mixer 10 shown in FIGS. 1 and 2, and for this reason, like reference numerals (however increased by a value of twenty) will be accorded to like features. It may be assumed that the features shown in FIGS. 3 and 4 are configured the same and perform the same purpose as those corresponding features shown in FIGS. 1 and 2, unless modified as described in the following paragraphs.

In the series of four annular steps 38 which extends along the generally conical inner mixing surface of stator 32, each of second surfaces 38*b* clearly extend further in the transverse direction than in the axial direction, i.e. the direction in which first surfaces 38*a* extend. Similarly, in the series of four annular steps 40 which extends along the generally conical mixing surface of rotor 31, again each of second surfaces 40*b* clearly extend further in the transverse direction than in the axial direction, i.e. the direction in which first surfaces 40*a* extend.

Of the plurality of cavities 43 provided in each of the annular steps 38 of stator 32, and the plurality of cavities 44 provided in each of the annular steps 40 of rotor 31, the mutual configurations of cavities 43, 44 on each of stator 32 and rotor 31 are such as to be offset but overlapping in the transverse direction relative to one another to facilitate movement of material from inlet 36 to outlet 37.

Importantly, in the transverse direction between non-overlapping cavities 43 of stator 32 and cavities 44 of rotor 31, annular mixing zones 45 are provided between the transversely extended second surfaces 38*b*, 40*b* of each of stator 32 and rotor 31 respectively. Gap 42 in the region of annular mixing zones 45 remains constant, thus providing regions of substantially uniform volume in which high extensional and/or shear stressing of the material (not shown) being mixed will be imparted.

Referring to FIG. 4, transverse second surfaces 40*b* of annular steps 40 of rotor 31 are shown. In each of these planar surfaces 40*b*, an equally spaced array of cavities 44 is provided. In the innermost annular step 40, four cavities 44*a* are formed. In the next annular step (having a larger diameter in accordance with the generally conical shape of rotor 31), twelve cavities 44*b* are formed. In the next annular step (having a yet larger diameter), twenty cavities 44*c* are formed. Finally, in the outermost annular step (having the largest diameter), twenty eight cavities 44*d* are formed. Each of the cavities 44 is part-spherical and arranged such that the periphery of each (apart from those located in the innermost annular step) extends across the full width of axial first surfaces 40*a*, but only part way along the width of transverse second surfaces 40*b*, which are extended in the transverse direction to provide annular mixing zones 45 which are illustrated in dotted-line outline in FIG. 4.

FIGS. 2 and 4 show the relative disposition of the various cavities 24, 44 in the two rotors 11, 31 respectively. Given that adjacent annular steps 20, 40 define differing numbers of cavities 24, 44, the paths of least resistance through mixer 10, 30 vary continuously as rotor 11, 31 turns within stator 12, 32. Material to be mixed thus follows a complex path which ensures excellent distributive and dispersive mixing, whilst also passing through at least one annular mixing zone 25, 45 where it is subjected to high extensional and/or shear stresses in addition.

Figure 5:
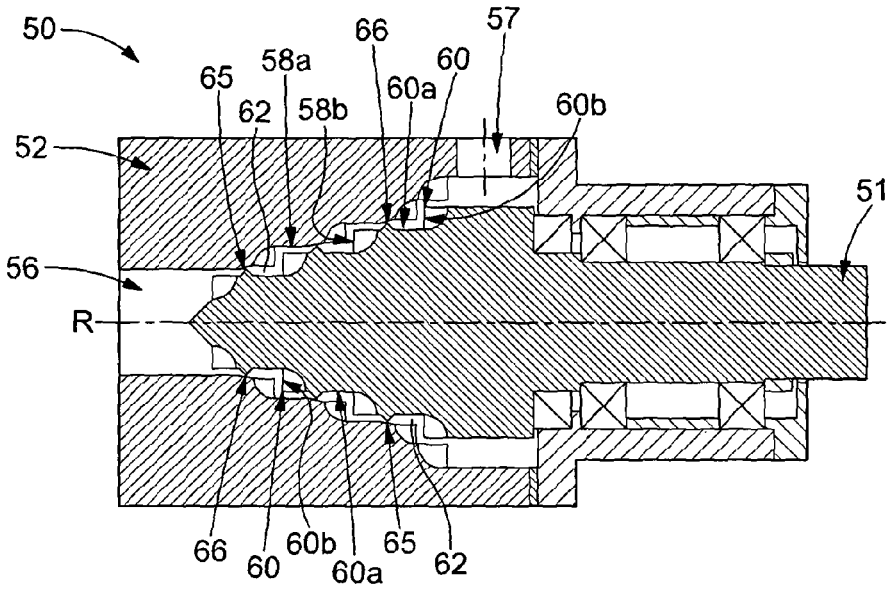
FIG. 5 is an axial section through a mixer according to a second embodiment of the present invention.
Figure 6:
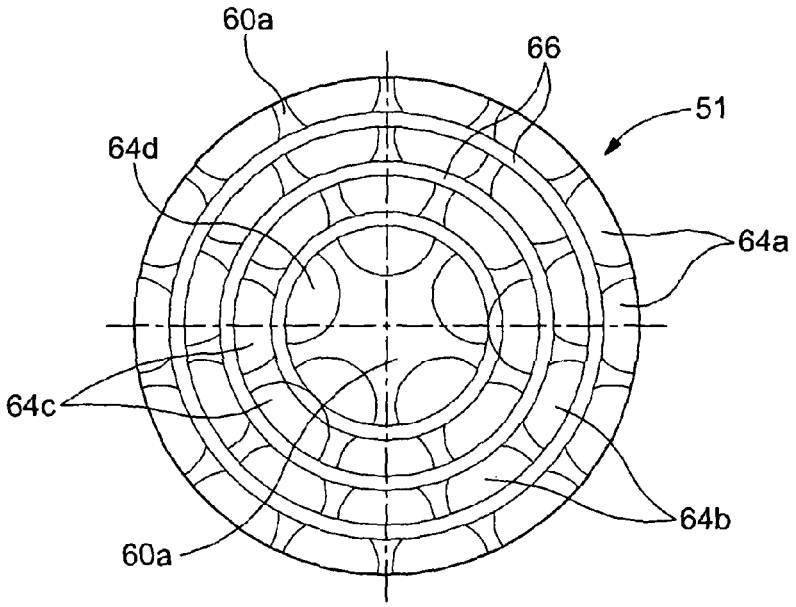
FIG. 6 is an end view of a mixing part of the mixer of FIG. 5.

Referring to FIGS. 5 and 6, dynamic mixer 50 is similar to dynamic mixer 10 shown in FIGS. 1 and 2, and for this reason, like reference numerals (however increased by a value of forty) will be accorded to like features. It may be assumed that the features shown in FIGS. 5 and 6 are configured the same and perform the same purpose as those corresponding features shown in FIGS. 1 and 2, unless modified as described in the following paragraphs.

In the series of four annular steps 60 which extend along the generally conical inner mixing surface of rotor 51, where each step 60 is defined by a first surface 60*a* which is cylindrical and centred on axis R (thus being an axial surface) and a second surface 60*b* which is planar and perpendicular to axis R (thus being a transverse surface), and where each of first surfaces 60*a* clearly extend further in the axial direction than in the transverse direction, i.e. the direction in which second surfaces 60*b* extend, an annular projection 66 is provided in the extended portion of each of first surfaces 60*a*.

Annular projection 66 has, for example in this particular embodiment, a triangular prismatic cross-section (which could also be truncated) which extends from surface 60*a* towards the extended portion of the corresponding first surface 58*a* of stator 52. Thus the gap 62 which exists by virtue of the closely spaced relationship between the first surfaces 58*a* of stator 52 with first surfaces 60*a* of rotor 51, and between the second surfaces 58*b* of stator 52 and second surfaces 60*b* of rotor 51, is reduced (e.g. to 10 μm or less) by the "nip" created between the tip of the triangular prismatic cross section of annular projection 66 and first surface 58*a* of stator so as to further increase the degree of stress that may be imparted to the material being mixed.

A further difference between the embodiments of the invention shown in FIGS. 1 to 4 and the current embodiment shown in FIGS. 5 and 6 lies in the fact that in the embodiment of FIGS. 1 to 4, the surfaces 18*a*, 18*b* and 38*a*, 38*b* of stator 12, 32 are mutually perpendicular. As shown in FIG. 5, other arrangements are possible however, for example where the extended portion of first surface 58*a* of stator 52 which forms annular mixing zone 65 is generally frusto-conical, with the cones being centred on axis R. With such a configuration, relative axial displacement between rotor 51 and stator 52 changes spacing/gap 62 between first surfaces 60*a*, 58*a* respectively, as well as the spacing between second surfaces 60*b*, 58*b* respectively and, most importantly, between the frusto-conical surface 58*a* and the tip of projection 66.

Figure 7:
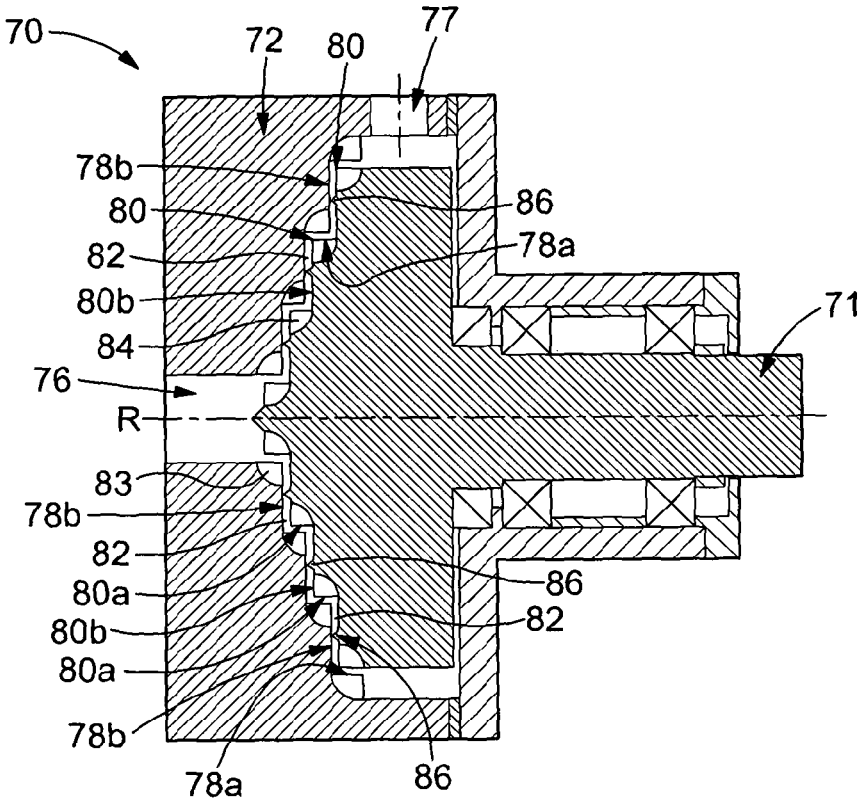
FIG. 7 is an axial section through an alternative mixer according to the first embodiment of the present invention.
Figure 8:
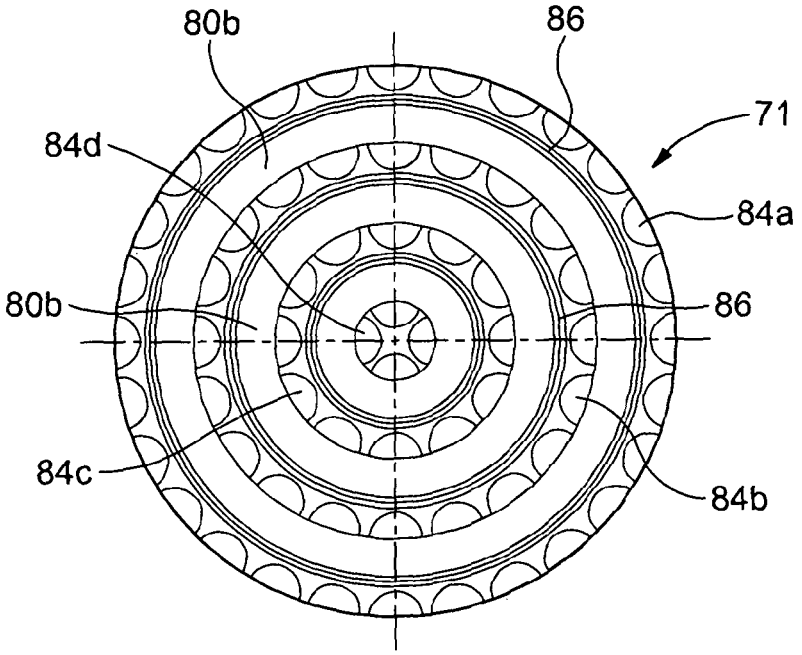
FIG. 8 is an end view of a mixing part of the mixer of FIG. 7.

Referring to FIGS. 7 and 8, dynamic mixer 70 is similar to dynamic mixer 30 shown in FIGS. 3 and 4, and for this reason, like reference numerals (however increased by a value of forty) will be accorded to like features. It may be assumed that the features shown in FIGS. 7 and 8 are configured the same and perform the same purpose as those corresponding features shown in FIGS. 3 and 4, unless modified as described in the following paragraphs.

In the series of four annular steps 80 which extend along the generally conical inner mixing surface of rotor 71, where each step 80 is defined by a first surface 80*a* which is cylindrical and centred on axis R (thus being an axial surface) and a second surface 80*b* which is planar and perpendicular to axis R (thus being a transverse surface), and where each of second surfaces 80*b* clearly extend further in the transverse direction than in the axial direction, i.e. the direction in which first surfaces 80*a* extend, an annular projection 86 is provided in the extended portion of each of second surfaces 80*b*.

Annular projection 86 has, for example in this embodiment, a triangular prismatic cross-section (which could also be truncated) which extends from second surface 80*b* towards the extended portion of the corresponding second surface 78*b* of stator 72. Thus the gap 82 which exists by virtue of the closely spaced relationship between the first surfaces 78*a* of stator 72 with first surfaces 80*a* of rotor 71, and between the second surfaces 78*b* of stator 72 and second surfaces 80*b* of rotor 71, is reduced (e.g. to 10 μm or less) by the "nip" created between the tip of the triangular prismatic cross section of annular projection 86 and second surface 78*b* of stator so as to further increase the degree of stress that may be imparted to the material being mixed.

Although not shown in FIG. 7, a further possible difference between the embodiments of the invention shown in FIGS. 1 to 4 and the current embodiment shown in FIGS. 7 and 8 would be to provide the extended portion of second surface 78*b* of stator 72 which forms annular mixing zone 85 in generally frusto-conical form, with the cones being centred on axis R. With such a configuration, relative axial displacement between rotor 71 and stator 72 would change spacing/gap 82 between second surfaces 80*b*, 78*b* respectively, as well as the spacing between first surfaces 80*a*, 78*a* respectively.

Of course, with regards to the relative locations of annular projections 66, 86 in the embodiments shown in FIGS. 5, 6, 7 and 8, it is possible that said projections could instead, or in addition, be provided on the other mixing part, i.e. if on the rotor, be provided on the stator in addition or in the alternative, or if on the stator, be provided on the rotor in addition or in the alternative.

Figure 9:
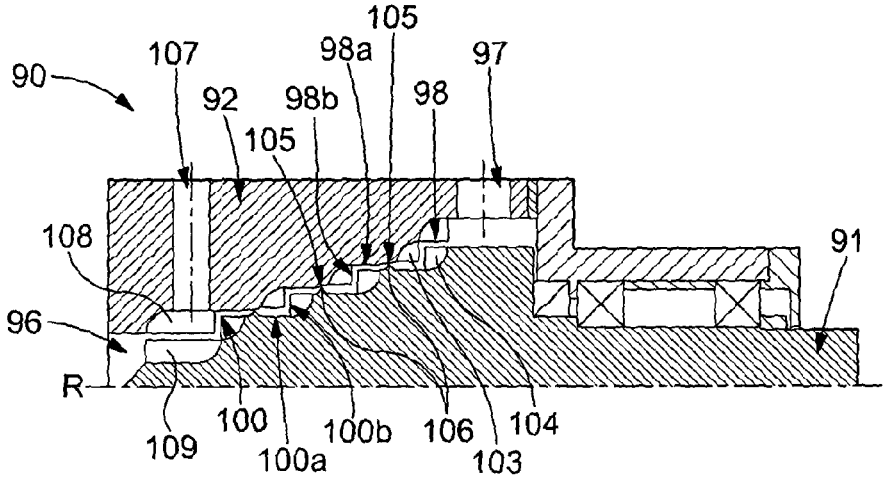
FIG. 9 is a partial axial section through a mixer according to a fourth embodiment of the present invention.

Turning to the embodiment shown in FIG. 9, dynamic mixer 90 is very similar to dynamic mixer 50 shown in FIGS. 5 and 6, and for this reason, like reference numerals (however increased by a value of forty) will be accorded to like features. It may be assumed that the features shown in FIG. 9 are configured the same and perform the same purpose as those corresponding features shown in FIGS. 5 and 6, unless modified as described in the following paragraphs.

Towards the end of stator 92 in which inlet 96 is provided, but perpendicularly thereto, an additional inlet 107 is provided through which a second or further stream of material to be mixed (not shown) may be incorporated into the material to be mixed (not shown) that has been introduced into mixer 90 via inlet 96. As a consequence, the primary cavities 108 provided in the first annular step 98 of stator 92 and the primary cavities 109 provided in the first annular step 100 of rotor 91 are elongate as compared to the remaining cavities in each; this is done so as to provide an increased volume in which turbulent flow conditions may be achieved when each of cavities 108, 109 overlap, with rotation of rotor 91 within stator 92 causing an initial mixing of materials through inlet 96 and additional inlet 107. By providing additional inlet 107 proximal to inlet 96, the second or further stream of material to be mixed is introduced early in the mixing process, which ensures excellent distributive and dispersive mixing via the turbulent mixing zones created in overlapping cavities 108, 109, prior to flow through mixer 90 to annular mixing zones 105 where high extensional and/or shear stresses are additionally imparted.

Figure 10:
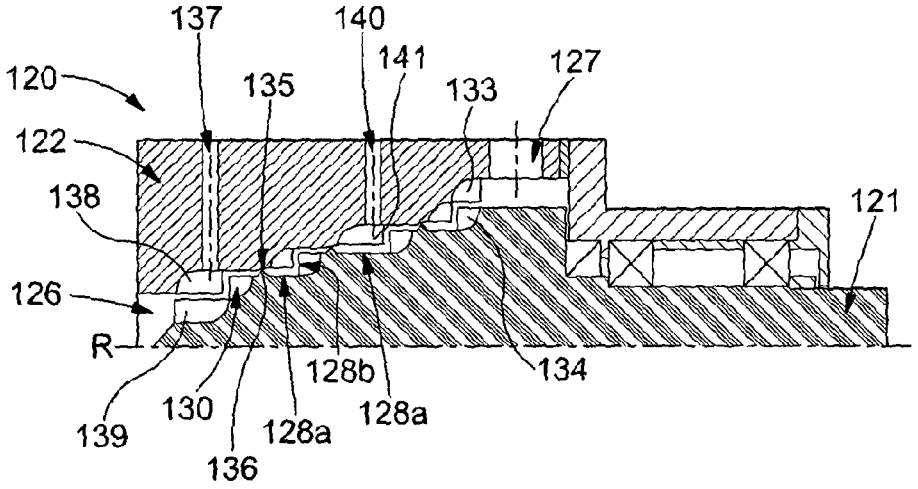
FIG. 10 is a partial axial section through a mixer according to a fifth embodiment of the present invention.

Turning to the embodiment shown in FIG. 10, dynamic mixer 120 is very similar to dynamic mixer 90 shown in FIG. 9, and for this reason, like reference numerals (however increased by a value of thirty) will be accorded to like features. It may be assumed that the features shown in FIG. 10 are configured the same and perform the same purpose as those corresponding features shown in FIG. 9, unless modified as described in the following paragraphs.

Towards the end of stator 122 in which inlet 126 is provided, but perpendicularly thereto, a first additional inlet 137 is provided through which a second or further stream of material to be mixed (not shown) may be incorporated into the material to be mixed (not shown) that has been introduced into mixer 120 via inlet 126. As a consequence, the primary cavities 138 provided in the first annular step 128 of stator 122 and the primary cavities 139 provided in the first annular step 130 of rotor 121 are elongate as compared to the remaining cavities in each. Provision of elongate cavities is optional, but more preferred with greater flow rates.

Furthermore, approximately mid-way along the axial length of stator 122, a second additional inlet 140 is provided through which a third or yet further stream of material to be mixed (not shown) may be incorporated into the material to be mixed that has been introduced into mixer 120 via inlet 126 and optionally also via first additional inlet 137. As a consequence of the presence of second additional inlet 140, the corresponding cavity 141 in stator 122 is made to be elongate (in the same manner as cavity 138) and the corresponding first surface 128*a* of rotor 121 is yet further extended so as to be co-extensive with elongate cavity 141. Provision of elongate cavity 141 is again done so as to provide an increased volume in which turbulent flow conditions may be achieved on mixing of the third or yet further stream of material through second additional inlet 140 with part-mixed material provided earlier in the flow path via inlet 126 and optionally also first additional inlet 137. By providing second additional inlet 140 approximately mid-way along stator 122 in the axial direction, a further control mechanism is provided to determine the form and timing of introduction of further material into the material flow path.

Figure 11:
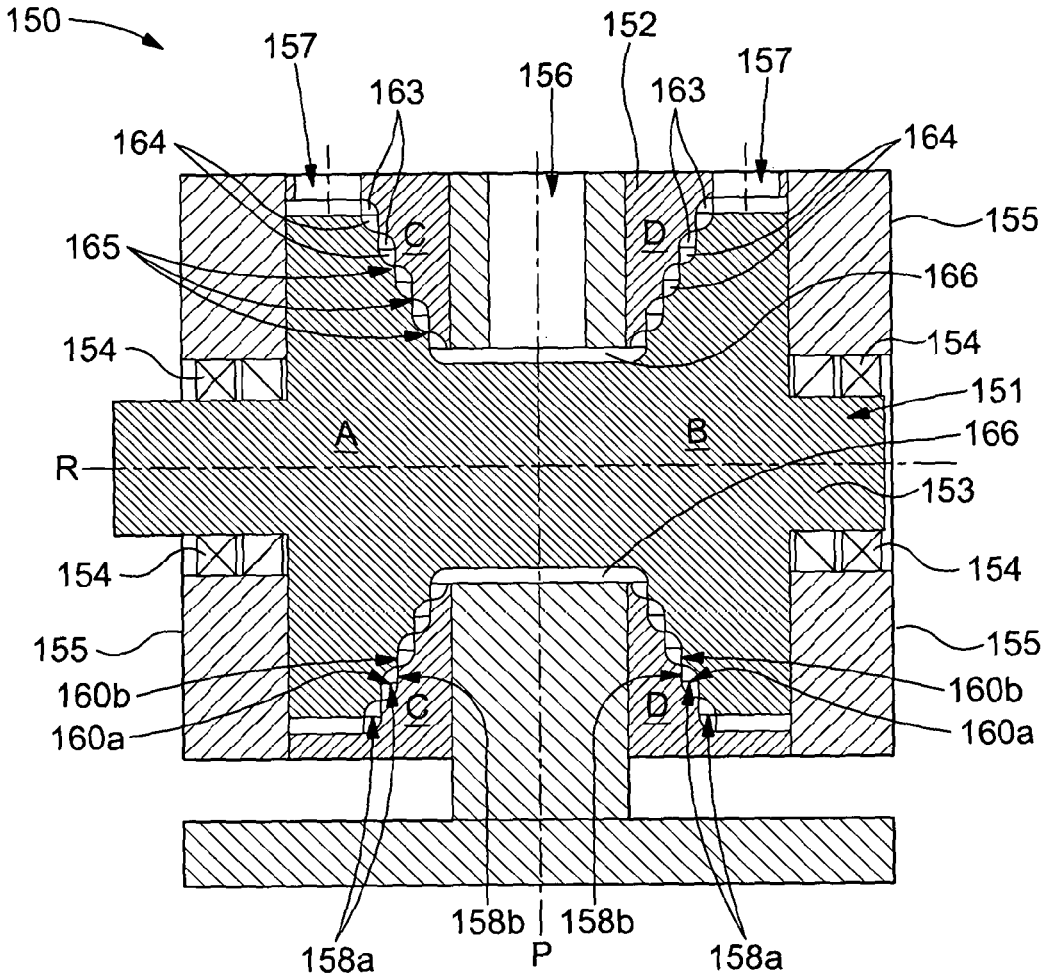
FIG. 11 is an axial section through a mixer according to a sixth embodiment of the invention.

Turning finally to FIG. 11, the illustrated dynamic mixer 150 comprises two mixing parts in the form of an outer rotor 151 and an inner stator 152 which are rotatable relative to each other, in this case rotor 151 being rotatable relative to static stator 152, about a predetermined axis of rotation R. Rotor 151 is mounted on a shaft 153, which is supported in bearings 154 within a housing 155. Stator 152 is mounted on housing 155. Stator 152 defines a mixer inlet 516 and two mixer outlets 157.

Rotor 151 is substantially symmetrical about axis of rotation R. Rotor 151 is also substantially symmetrical about an axis P that is perpendicular to axis R, resulting in a "double-barrelled" rotor 151 which effectively corresponds to rotor 31 shown in FIGS. 3 and 4 (labelled 'A') conjoined to its mirror image (labelled 'B') about axis R. Stator 152 is configured similarly so as to comprise part 'C' (which effectively corresponds to stator 32 shown in FIG. 3) conjoined to its mirror image (labelled 'D').

Each of stator parts C and D comprises a series of four annular steps 158 which extend along their generally conical inner mixing surfaces, each step 158 being defined by a first surface 158*a* which is cylindrical and centred on axis R (thus being an axial surface) and a second surface 158*b* which is planar and perpendicular to axis R (thus being a transverse surface). A recess 159 is formed where the first surface 158*a* of one step 158 meets the second surface 158*b* of the adjacent step 158. Each of second surfaces 158*b* clearly extends further in the transverse direction than in the axial direction, i.e. the direction in which first surfaces 158*a* extend.

Each of rotor parts A and B similarly support four annular steps 160 which extend along their generally conical outer mixing surfaces, each step 160 being defined by a first surface 160*a* which is cylindrical and centred on axis R (thus being an axial surface) and a second surface 160*b* which is planar and perpendicular to axis R (thus being a transverse surface). A recess 161 is formed where the first surface 160*a* of one step 160 meets the second surface 160*b* of the adjacent step 160. Again each of second surfaces 160*b* clearly extends further in the transverse direction than in the axial direction, i.e. the direction in which first surfaces 160*a* extend.

As shown in FIG. 1 with stator 152 located within the hollow of double-barrelled rotor 151, first surfaces 158*a* of stator 152 are in a closely spaced relationship with first surfaces 160*a* of rotor 151, whilst second surfaces 158*b* of stator 152 are in a closely spaced relationship with second surfaces 160*b* of rotor 151, with the closely spaced relationship defining a small gap 162 (for example of the order of 50 μm) therebetween.

Clearly gap 162 is not linear as it extends from inlets 156 to outlets 157 as it traces the stepped conical shapes of each of the parts A and B of rotor 151 and corresponding parts C and D of stator 152. Thus material (not shown) passing from inlet 156 to outlets 157 is unable to follow a linear path.

A plurality of cavities 163 is provided in each of the annular steps 158 of stator 152, and a plurality of cavities 164 is provided in each of the annular steps 160 of rotor 151. The mutual configurations of cavities 163, 164 on each of stator 152 and rotor 151 are such as to be offset but overlapping in the transverse direction relative to one another to facilitate movement of material from inlet 156 to outlets 157.

Importantly, in the transverse direction between non-overlapping cavities 163 of stator 152 and cavities 164 of rotor 151, annular mixing zones 165 are provided between the transversely extended second surfaces 158*a*, 160*a* of each of stator 152 and rotor 151 respectively. Gap 162 in the region of annular mixing zones 165 remains constant, thus providing regions of substantially uniform volume in which high extensional and/or shear stressing of the material (not shown) being mixed will be imparted.

Furthermore, it should be noted that gap 162 is narrowed from an initial volume in the form of a mixing annulus 166 which opens from inlet 156 to outlets 157. Material to be mixed (not shown) introduced into inlet 156 is rotated around rotor shaft 153 in mixing annulus 166 (which is co-extensive in the axial direction with rotor shaft 153 in its sections between parts A and B) prior to being compelled upwardly and outwardly along the stepped conical paths defined by annular steps 158, 160 to each of outlets 157. The benefit of this configuration is that the axial separating forces that arise in annular mixing zones 165 are balanced about the axis of symmetry P. This reduces or eliminates the resultant axial loads on bearings 154. If so desired, rotor 151 is capable of centring itself axially between stators 152.

Of course, although not shown in the embodiment in FIG. 11, any one or more of the modifications described with respect to any of FIGS. 5 to 10, such as the presence of projections, may be incorporated into the embodiment of FIG. 11 so as to achieve the additional means of control previously described.

Furthermore, geometrical asymmetries (between parts A and C and between parts B and D) about R can produce different flow regimes in the two sides while providing some measure of hydraulic balancing. For instance, narrower gaps between A and C will result in a higher specific mixing energy than that being applied between B and D. Such differences can be exploited to achieve different material properties, such as emulsion droplet size, between the two exiting flow streams: these can then be blended to yield a bimodal particle size distribution from a single machine.

Symmetries may also be achieved in other ways, for instance cavities 163, 164 could be located outboard of the axis of outlets 157.

With all of the embodiments of the invention herein described, each of the rotor and/or the stator may be equipped with fluid passages and/or surfaces for heating and/or cooling.

Specific applications to which a dynamic mixer according to any of the aforementioned embodiments of the invention may be applied include:

1. The formation of oil-water emulsions. For example, within the petrochemical industry, applications include:
   (i) formation of oil-in-water (O/W) emulsions for the purpose of viscosity reduction of heavy-fraction oils;
   (ii) water-in-oil (W/O) emulsions for the purposes of cost reduction and improved emission control; and
   (iii) oil-reagent mixing for the purpose of enhancing reaction rates.
2. The size reduction of solid, semi-solid and/or high-viscosity particles within, and the blending with, low and/or high viscosity fluids. For example, within the food industry, applications include:
   (i) comminution of sugar crystals;
   (ii) refining of edible fats; and
   (iii) comminution of chocolate solids.

Also by way of example, within the polymer industry, applications include the comminution and blending of solid ingredients, such as fillers and reagents, within a base polymer.

The size reduction of solid, semi-solid and/or high-viscosity particles within, and the blending with, low and/or high viscosity fluids may lead to modification of the viscosities of these materials. For example, within the polymer industry, applications include:

(i) rupturing of intramolecular linkages, for instance carbon-sulphur bonds; and
(ii) solubilisation of previously linked hydrocarbon chains.

Within the food industry, applications include:

(i) refining of chocolate; and
(ii) conching of chocolate.

Furthermore, the size reduction of solid, semi-solid and/or high-viscosity particles within, and the blending with, low and/or high viscosity fluids may lead to enhancement of reaction rates of materials and material systems.

The invention claimed is:

1. A stepped conical geometry dynamic mixer comprising:

two mixing parts which are rotatable relative to each other about a predetermined axis of rotation, each of said mixing parts having a generally conical mixing face, between which is defined a flow path which extends between an inlet for material to be mixed and an outlet, each of said generally conical mixing faces comprising a series of annular steps centred on the predetermined axis of rotation and defining said generally conical mixing faces, said series of annular steps having a plurality of cavities formed therein, said cavities defining flow passages bridging adjacent steps on each of the two mixing parts, each of said generally conical mixing faces being mutually positionable such that the steps of one mixing part extend towards recesses formed between the steps of the other mixing part, whereby cavities present in one generally conical mixing face are offset relative to, and overlap with, cavities present in the other generally conical mixing face in an axial direction or a transverse direction, such that material moving between the generally conical mixing faces of the two mixing parts from the inlet to the outlet is transferrable between overlapping cavities, wherein at least one step of one of the mixing parts and at least one adjacent step of the other of the mixing parts extends further in the axial direction than in the transverse direction, or vice versa, such that at least one annular mixing zone of substantially uniform volume is provided in between non-overlapping cavities of the two mixing parts, wherein each step is defined by a first surface which is cylindrical and centered on said predetermined axis of rotation and a second surface which is planar and perpendicular to said predetermined axis of rotation, wherein a respective one of said recesses is formed where said first surface meets the second surface of an adjacent step, wherein said first surface extends further in the axial direction than the second surface in the transverse direction or vice versa.

2. The mixer as claimed in claim 1 wherein each step of the series of annular steps comprises a pair of substantially orthogonal surfaces.

3. The mixer as claimed in claim 2 wherein extension of the at least one step of one of the mixing parts and extension of the at least one adjacent step of the other of the mixing parts results in a pair of mutually opposed, continuous, annular surfaces forming the at least one annular mixing zone.

4. The mixer as claimed in claim 3 wherein one of the surfaces extends substantially parallel to the predetermined axis of rotation, and one of the surfaces extends substantially transversely to said axis of rotation.

5. The mixer as claimed in claim 3 wherein the pair of mutually opposed annular surfaces both extend substantially parallel to the predetermined axis of rotation.

6. The mixer as claimed in claim 5 wherein one of the surfaces of the pair of mutually opposed annular surfaces extends at an acute angle to the predetermined axis of rotation.

7. The mixer as claimed in claim 3 wherein the pair of mutually opposed annular surfaces both extend substantially transversely to the predetermined axis of rotation.

8. The mixer as claimed in claim 7 wherein one of the surfaces of the pair of mutually opposed annular surfaces extends at an acute angle transversely to the predetermined axis of rotation.

9. The mixer as claimed in claims 3 wherein at least one of the surfaces of the pair of mutually opposed annular surfaces is provided with a projection which projects towards to the other of the surfaces in the pair.

10. The mixer as claimed in claim 9 wherein the projection is in the form of an annular prism.

11. The mixer as claimed in claim 1 wherein an array of circumferentially spaced cavities is formed in a step of the series of annular steps.

12. The mixer as claimed in claim 11 wherein at least one of the cavities is branched such that a flow of material entering the cavity is divided into separate flow paths, or separate flows of material entering the cavity are combined into a single flow path.

13. The mixer as claimed in claim 11 wherein adjacent steps of the series of annular steps in a mixing part comprise different numbers of cavities.

14. The mixer as claimed in claim 11 wherein adjacent steps of the series of annular steps in a mixing part comprise different sizes of cavities.

15. The mixer as claimed in claim 1 wherein one mixing face is defined by an inner surface of a hollow outer mixing part and the other mixing face is defined by an outer surface of an inner mixing part.

16. The mixer as claimed in claim 1 wherein the inlet is defined so as to extend substantially parallel to the predetermined axis of rotation, whilst the outlet is defined so as to extend substantially transversely to said axis, or vice versa.

17. The mixer as claimed in claim 1 wherein each of the inlet and outlet are defined so as to extend substantially transversely to the predetermined axis of rotation.

18. The mixer as claimed in claim 1, wherein the cavities are formed on edges of the steps.

* * * * *